United States Patent [19]

Thompson

[11] 4,360,001

[45] Nov. 23, 1982

[54] FIRE ARRAY AND APPARATUS

[76] Inventor: E. Arthur Thompson, P.O. Box 456, Penllyn, Pa. 19422

[21] Appl. No.: 270,923

[22] Filed: Jun. 5, 1981

Related U.S. Application Data

[63] Continuation-in-part of Ser. No. 27,620, Apr. 6, 1979, Pat. No. 4,271,817.

[51] Int. Cl.[3] ..... F23B 13/00

[52] U.S. Cl. ..... 126/164; 126/152 B; 126/298; 211/60 R

[58] Field of Search ..... 126/164, 165, 152 B, 126/298, 152 R, 201, 202; 211/60 R; D7/207, 211

[56] References Cited

U.S. PATENT DOCUMENTS

| | | | |
|---|---|---|---|
| 2,985,165 | 5/1961 | Peterson et al. | 126/165 |
| 3,612,034 | 10/1971 | Wood | 126/165 |
| 3,838,679 | 10/1974 | Welch | 126/165 |
| 4,271,817 | 6/1981 | Thompson | 126/152 B |

FOREIGN PATENT DOCUMENTS

| | | | |
|---|---|---|---|
| 2375549 | 8/1978 | France | 126/164 |

*Primary Examiner*—James C. Yeung

[57] ABSTRACT

An array for a log fire is described which promotes ignition and even burning of the logs. The array includes at least three logs, split or unsplit, which are maintained in a nested spaced apart relationship by an implement which creates a V-shaped locus between the facing log surfaces. One such implement is described as having a central rectilinear portion having affixed at each end thereof similar V-shaped portions upstanding therefrom, and oriented so as to form intersecting parallel planes. Another implement is described as having a central rectilinear portion, each end of which is bent to about a right angle therefrom and at a degree of displacement from the angle to which the other end is bent so that each end falls within one of two intersecting planes whose intersection lies along the rectilinear portion. Another implement is described as including at least a pair of similar V-shaped members which may be individually spaced apart within an array of logs so as to provide for improved ignition and even burning.

Another implement is described as having a V-shaped portion rigidly mounted to a base plate portion normally thereto and a T-shaped portion rigidly mounted to the opposite side of the base plate portion normally thereto so as to depend therefrom. The planes formed by the V-shaped portion and the T-shaped portion are set during manufacture at an angle relative to each other of about 90 degrees. A pair of these implements are used in combination with a grate device to form an apparatus for use in an array for a log fire.

1 Claim, 10 Drawing Figures

FIRE ARRAY AND APPARATUS

CROSS REFERENCE TO RELATED APPLICATION

This application is a continuation-in-part of my pending application Ser. No. 027,620, filed Apr. 6, 1979, now U.S. Pat. No. 4,271,817.

BRIEF SUMMARY OF THE INVENTION

The burning of wood fires in private residences and elsewhere has heretofore mainly been for personal enjoyment and as supplementary heating. However, with increased environmental concern the economic use of wood fires has become a matter of general interest. Certain disadvantages of wood fires are well known. Among these are the difficulty in igniting the wood, the difficulty of maintaining the fire for long periods of time and the difficulty of achieving a flame pattern which will consume the wood fuel by the piece evenly throughout the length of the piece.

The apparatus of this invention tends to reduce these advantages to a minimum and produce an efficient, attractive and economic fire, as further described and shown in the drawings wherein.

DETAILED DESCRIPTION OF THE DRAWINGS

Figure 1:
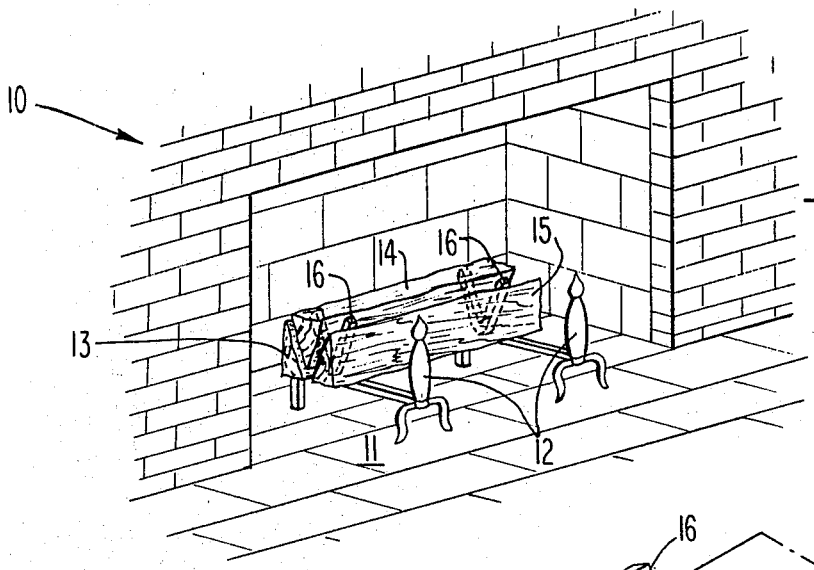
FIG. 1 is a perspective view of a fireplace set with a log fire array of this invention.
Figure 2:
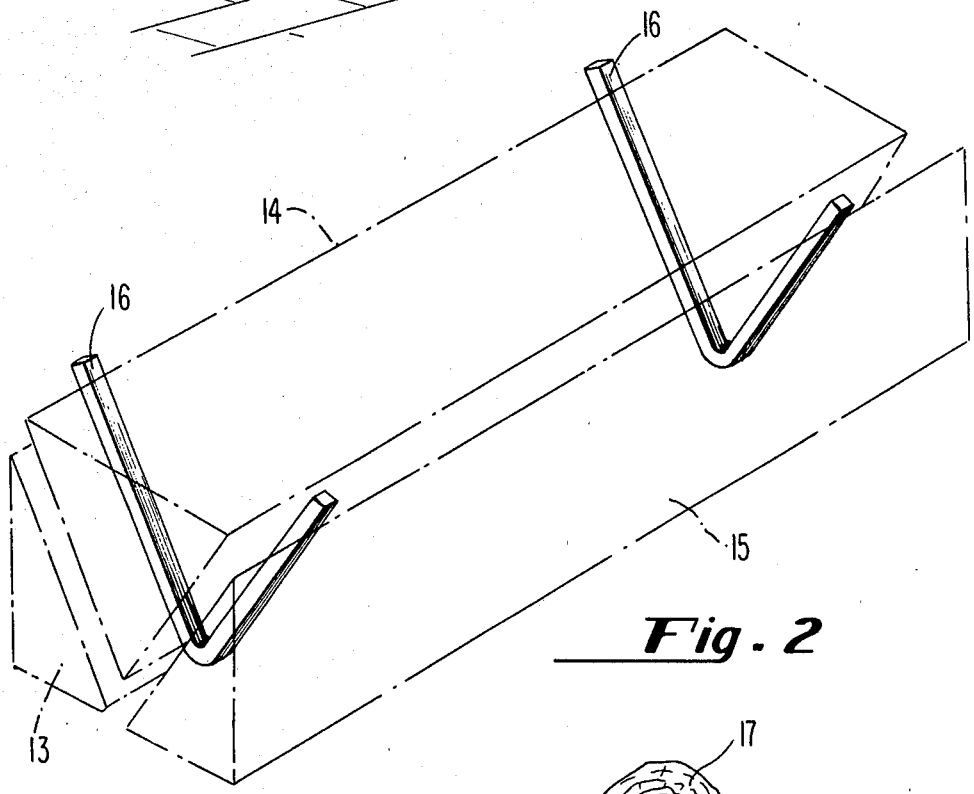
FIG. 2 is an enlarged view of a portion of FIG. 1, the logs being shown in phantom lines.
Figure 3:
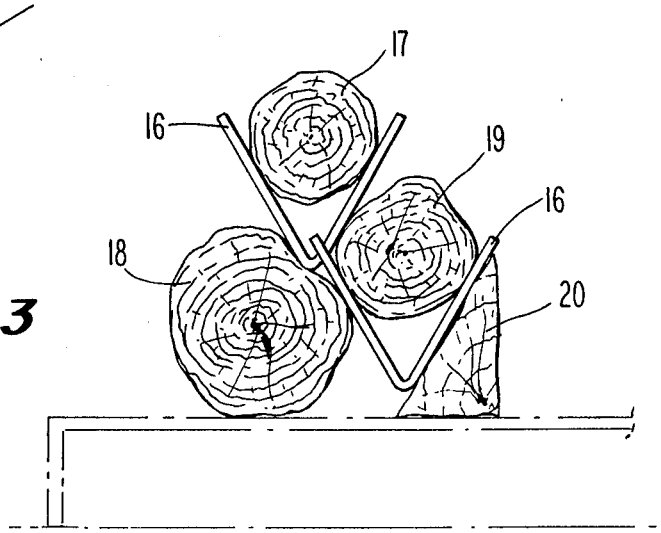
FIG. 3 is an end view of another log fire array in accordance with this invention, the andiron being shown in phantom lines.

Referring now to FIG. 1, a fireplace 10, consisting of a hearth 11 and andirons 12, is set with an array of three logs 13, 14 15, in preparation for a fire. The logs 13, 14, 15, are split logs having flat angular sides, which enables the logs to be nested as shown in FIG. 1, with the assistance of two implements 16. The implements 16 are generally V-shaped and are formed from heavy metal bar or rod stock, such as wrought iron or the like. When the array is formed as shown, logs 13 and 15 are first arranged on the andirons 12 and spaced apart by dropping the two implements 16 therebetween. As log 14 is placed into the space formed between log 13 and log 15, the implements 16 act to maintain a V-shaped locus between the facing log surfaces of logs 13, 14, 15 as shown in FIG. 2. This V-shaped locus creates a desirable draft space for the ignition and maintenance of a log fire. It is therefore only necessary to deposit light twigs, kindling or rolled paper under the nested logs and to ignite such material, in order to bring about a good log fire. Once begun, a fire is easily maintained when the array of this invention is utilized. Firstly, the V-shaped implements 16 act to maintain the desirable draft between logs 13, 14, 15 as the logs are consumed, by the force of gravity. If necessary or desired, further adjustments may readily be made by utilizing fire tongs to position the implements 16 while easily maintaining the desired log array. In FIG. 2, where logs 13, 14, 15 are shown in phantom lines, the function of implements 16 is clearly shown. Referring now to FIG. 3, it is seen that other desirable log fire arrays may be fashioned in accordance with the log array of this invention by using the novel implements of this invention. The additional arrays, for example, may include more than three logs, and also may be arranged with logs of varying shapes and sizes. For instance, in FIG. 3, the array shown comprises three round logs 17, 18, 19 and one split log 20. All of these logs are maintained in a desirable array by means of implements 16.

Figure 4:
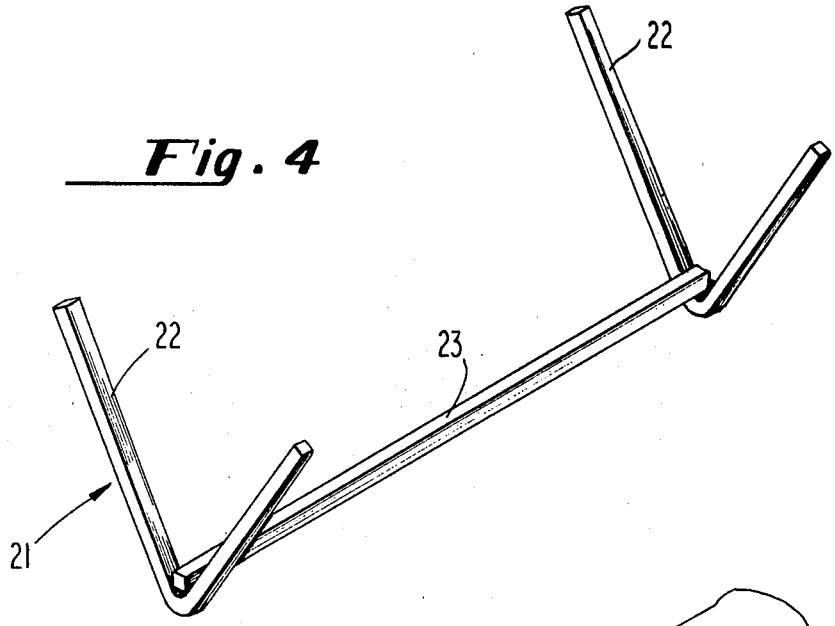
FIG. 4 is a perspective view of a fire implement in accordance with an embodiment of this invention.

Now referring to FIG. 4, another implement 21 for use in creating a log fire array is shown consisting of two tuxtaposed V-shaped portions 22, which are rigidly connected by a straight bar 23. This implement has the advantage of always maintaining the alignment of portions 22 to more readily create the V-shaped draft space between logs.

Figure 5:
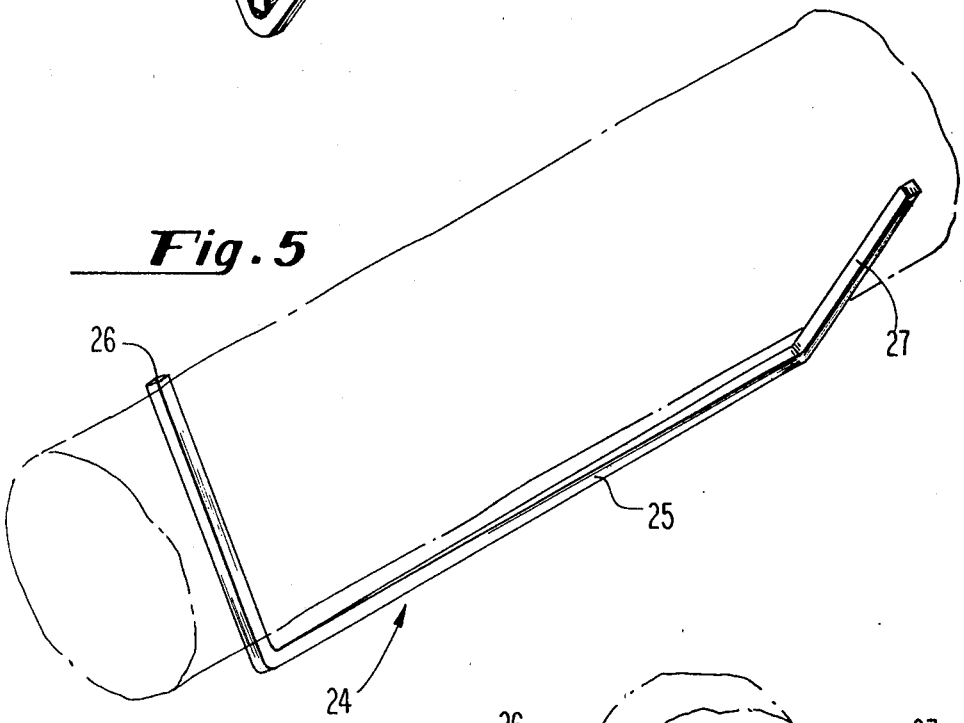
FIG. 5 is a perspective view of a fire implement in accordance with another embodiment of this invention, a log being shown in phantom lines.
Figure 6:
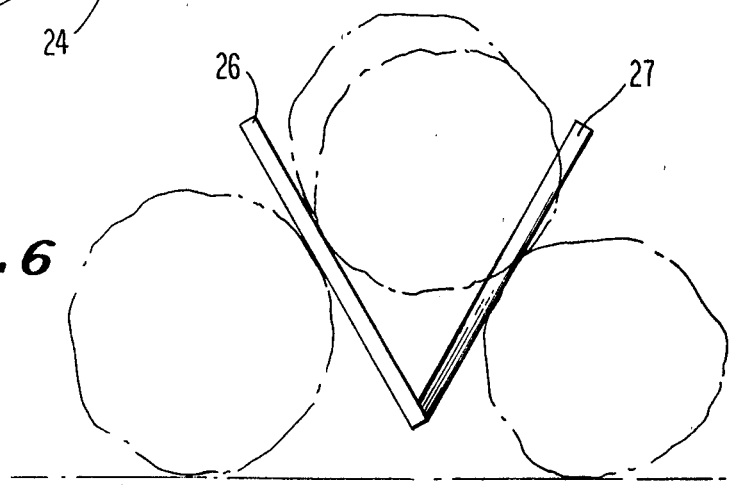
FIG. 6 is an end view of the implement shown in FIG. 5 in use to create an array in accordance with this invention.

Also, in FIG. 5, a till further implement 24 for use in the same manner as implement 21 is shown consisting of a rectilinear central portion 25 and bent end portions 26, 27 at opposite ends thereof. The angle chosen between the bent end portions 26, 27 more clearly shown in FIG. 6 is such as to form the V-shaped draft space necessary to form the log array of this invention. It is apparent that end portions 26, 27, while bent to about a right angle with respect to portion 25, are bent at different rotational angles about the axis of portion 25. It will readily be seen that implement 24, while performing the same function as implement 21, is simpler and of more economical construction.

The use of the log fire array and implements of this invention unexpectedly make is possible for customary fireplace logs to be ignited and maintain combustion throughout substantially their full length, with a resultant more efficient and more attractive fire.

Figure 7:
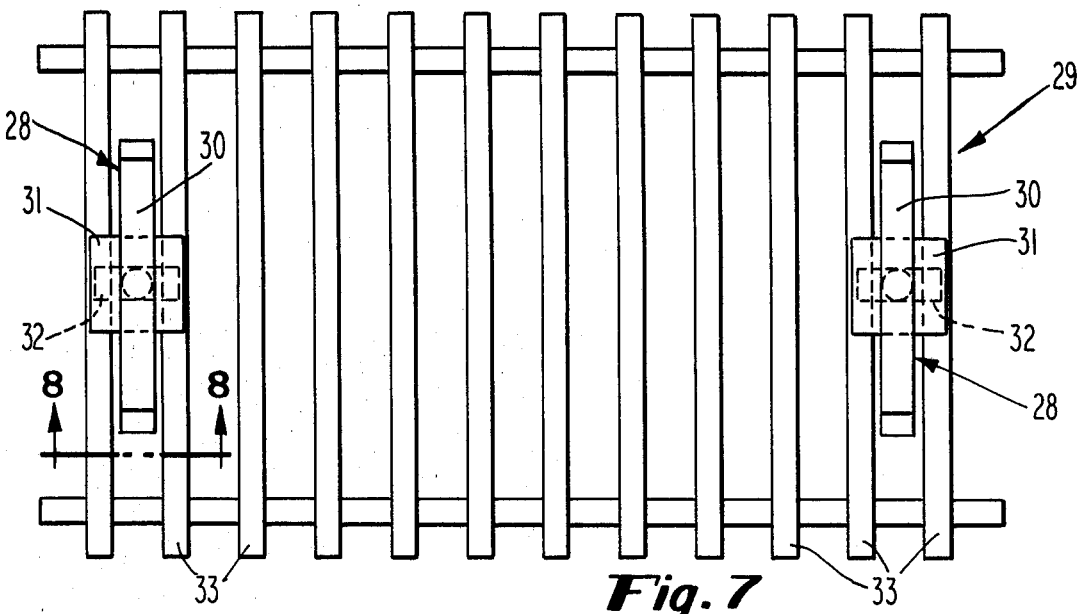
FIG. 7 is a top plan view of a fire grate combined with fire implements in accordance with an embodiment of this invention.
Figure 8:
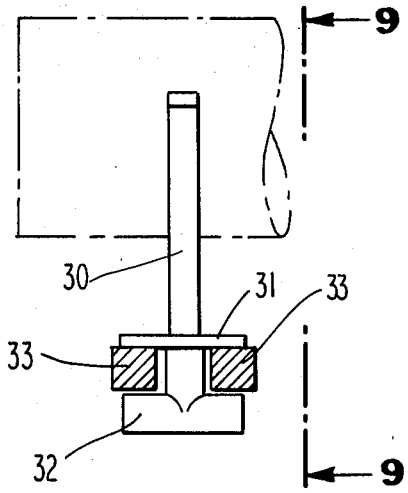
FIG. 8 is a sectional view taken in the direction of the arrows 8—8 of FIG. 7; a log being shown in phantom lines.
Figure 9:
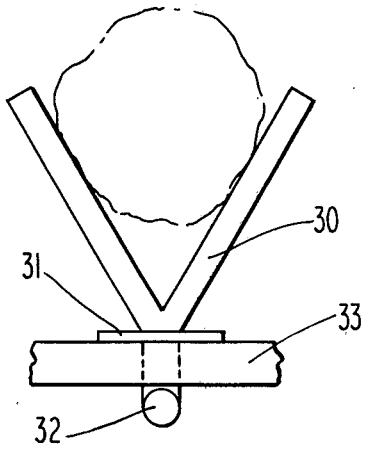
FIG. 9 is a view in the direction of the arrows 9—9 of FIG. 8.
Figure 10:
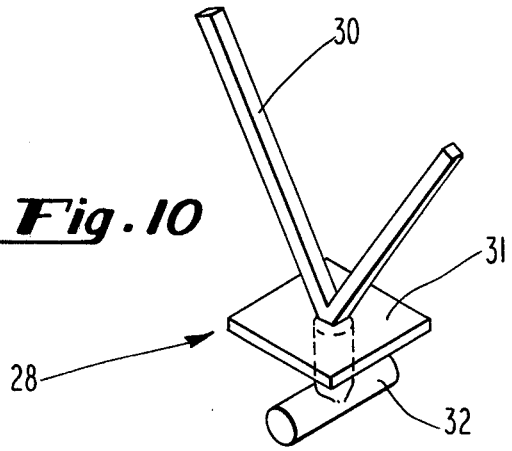
FIG. 10 is a perspective view of a fire implement in accordance with an embodiment of this invention.

Now referring to FIGS. 7 and 10, another implement 28 is shown for use in combination with a conventional grate 29 in creating a log fire array apparatus. The implement 28 includes a V-shaped portion 30 which is welded or otherwise rigidly affixed to a flat base plate portion 31 normally thereto, and a T-shaped portion 32 which is welded or otherwise rigidly affixed to the opposite side of base plate portion 31 normally thereto so as to depend therefrom, the planes formed by the V-shaped portion and the T-shaped portion being set during manufacture at an angle relative to each other of about 90 degrees. From FIGS. 7, 8 and 9 it is seen that a log array apparatus may be formed by inserting a pair of implements 28 by means of their T-shaped portions between spaced parallel cross bars 33 of the grate 29. The implements 28 are rotated about 90 degrees to the position shown in FIG. 7. In this manner it is seen that the base plate portion 31 and the T-shaped portion 32 cooperate with the spaced bars 33 to provide sufficient support for the upstanding V-shaped protions to enable the support of a log in an array in accordance with this invention. From FIG. 8 it is seen that the implement 28 should be dimensioned so as to have a loose fit with the spaced bars 33 to allow for thermal expansion during a fire.

Having thus described my invention, I claim:

1. Fireplace apparatus including in combination a fire resistant metal grate having a plurality of parallel spaced apart bars and a pair of fireplace implements moveably engaging the grate at two spaced apart portions thereof, each implement comprising a fire resistant metal structure consisting of a V-shaped portion, a substantially flat base plate portion and a T-shaped portion, the V-shaped portion being rigidly affixed normally to one side of the base plate portion ad the T-shaped portion being rigidly affixed to the opposite side of the base plate portion so as to depend therefrom, whereby the top of the T-shape is spaced apart from the base plate portion, the plane of the V-shaped portion and the plane of the T-shaped portion being set relative to each other at about 90 degrees, and each member of the pair having its V-shaped portion oriented parallel to the parallel spaced apart bars, thereby causing the base plate portion and T-shaped portion to loosely engage two adjacent parallel bars in a log supporting manner.

* * * * *